US012492493B2

(12) United States Patent
Chen et al.

(10) Patent No.: US 12,492,493 B2
(45) Date of Patent: Dec. 9, 2025

(54) WOVEN BRUSHED ELASTIC FABRIC AND METHOD OF MAKING THE SAME

(71) Applicant: SINGTEX INDUSTRIAL CO., LTD., New Taipei (TW)

(72) Inventors: Kuo-Chin Chen, New Taipei (TW); Sung-Yun Huang, New Taipei (TW); Chia-Cheng Chou, New Taipei (TW); Chih-Wei Chen, New Taipei (TW); Li-Hsun Chang, New Taipei (TW)

(73) Assignee: SINGTEX INDUSTRIAL CO., LTD., New Taipei (TW)

( * ) Notice: Subject to any disclaimer, the term of this patent is extended or adjusted under 35 U.S.C. 154(b) by 527 days.

(21) Appl. No.: 17/843,490

(22) Filed: Jun. 17, 2022

(65) Prior Publication Data

US 2022/0316111 A1 Oct. 6, 2022

Related U.S. Application Data

(62) Division of application No. 15/870,437, filed on Jan. 12, 2018, now abandoned.

(30) Foreign Application Priority Data

Jan. 26, 2017 (TW) ..... 106103175

(51) Int. Cl.
*D03D 27/00* (2006.01)
*D03D 15/56* (2021.01)
(Continued)

(52) U.S. Cl.
CPC ..... *D03D 27/00* (2013.01); *D03D 15/56* (2021.01); *D06C 7/00* (2013.01); *D06C 13/08* (2013.01);
(Continued)

(58) Field of Classification Search
CPC ..... D03D 27/00; D03D 15/56; D03D 39/24; D03D 39/14; D03D 27/02; D03D 27/04;
(Continued)

(56) References Cited

U.S. PATENT DOCUMENTS 1,575,127 A * 3/1926 Podhradsky ..... D03D 39/24 30/294
2,108,046 A 2/1938 Drobile
(Continued)

FOREIGN PATENT DOCUMENTS

CN 1563535 A 1/2005
CN 103422231 A 12/2013
(Continued)

OTHER PUBLICATIONS

English translation CN 103422231 A (Year: 2013).*
(Continued)

*Primary Examiner* — Amy Vanatta
(74) *Attorney, Agent, or Firm* — HSML P.C.

(57) ABSTRACT

A woven brushed elastic fabric includes a fabric blank and a plurality of yarn segments. The fabric blank is formed by interweaving a plurality of first yarns and composite yarns. Each composite yarn is composed of a second yarn and an elastic yarn. The second yarn is wound around the elastic yarn. The fabric blank has a first side, and a second side opposite to the first side and formed with a plurality of yarn loops. The yarn loops are formed by the interweaving of the first yarns and the composite yarns in a skip manner along a first direction or a second direction transverse to the first direction. The yarn segments are formed on the second side of the fabric blank by breaking at least some of the yarn loops.

15 Claims, 7 Drawing Sheets

(51) Int. Cl.
*D06C 7/00* (2006.01)
*D06C 13/08* (2006.01)

(52) U.S. Cl.
CPC .... *Y10T 428/2395* (2015.04); *Y10T 442/3073* (2015.04); *Y10T 442/3081* (2015.04)

(58) Field of Classification Search
CPC ..... D03D 27/06; D06C 13/08; D06C 7/00; D06C 7/02; D06C 13/06; D06C 13/00; D06C 27/00; D06C 2700/29; Y10T 428/2395; Y10T 442/3073; Y10T 442/3081; A41D 31/102; D10B 2403/0241
See application file for complete search history.

(56) References Cited

U.S. PATENT DOCUMENTS

| | | | | | |
|---|---|---|---|---|---|
| 2,116,048 | A * | 5/1938 | Smith | D04H 11/04 | 156/204 |
| 2,754,578 | A * | 7/1956 | Groat | D02G 3/445 | 139/426 R |
| 3,017,740 | A * | 1/1962 | Humphreys | D02G 3/324 | 57/309 |
| 4,000,342 | A | 12/1976 | Rochelle et al. | | |
| 4,668,552 | A * | 5/1987 | Scott | D03D 27/10 | 428/377 |
| 4,668,553 | A * | 5/1987 | Scott | D03D 27/00 | 428/377 |
| 5,084,322 | A * | 1/1992 | Brioschi | D03D 17/00 | 428/95 |
| 6,202,264 | B1 * | 3/2001 | Ishihara | D03D 27/00 | 24/445 |
| 2005/0031828 | A1 * | 2/2005 | Yoshida | B08B 1/143 | 428/95 |
| 2017/0238635 | A1 * | 8/2017 | Oh | D01F 6/62 | |

FOREIGN PATENT DOCUMENTS

| | | | | |
|---|---|---|---|---|
| EP | 3354776 | A1 * | 8/2018 | A47L 13/16 |
| GB | 2 021 166 | A | 11/1979 | |
| JP | 62-223336 | A | 10/1987 | |
| KR | 20100063948 | A * | 6/2010 | |
| WO | WO-2017094931 | A1 * | 6/2017 | D02G 3/04 |

OTHER PUBLICATIONS

English translation KR 20100063948 A (Year: 2010).*
Search Report issued to European counterpart application No. 18152340.8 by the EPO on Jun. 7, 2018.

* cited by examiner

WOVEN BRUSHED ELASTIC FABRIC AND METHOD OF MAKING THE SAME

CROSS-REFERENCE TO RELATED APPLICATION

This application claims priority of Taiwanese Patent Application No. 106103175, filed on Jan. 26, 2017.

FIELD

The disclosure relates to a fabric, more particularly to a woven brushed elastic fabric and a method of making the same.

BACKGROUND

A common method of making a fabric includes weaving and knitting. Fabric made from weaving has characteristics, such as light weight, high density, abrasion resistance, waterproof and windproof. Fabric made from knitting has characteristics, such as elasticity, softness and breathability.

However, the clothing structure made from weaving has a high density, is rigid and is not elastic, so that a user may feel discomfort after using it for a long time. On the other hand, the clothing structure made from knitting has a low density and a loose surface, is not windproof, is not abrasion resistance, and is prone to damage when hooked to an object.

A method of making a fabric having the advantages of the fabrics made from the weaving and knitting methods is an issue to be pursued by the textile industry.

SUMMARY

Therefore, an object of the present disclosure is to provide a woven brushed elastic fabric that has the advantages of the fabrics made from the weaving and knitting methods and a method of making the same.

According to one aspect of this disclosure, a woven brushed elastic fabric comprises a fabric blank and a plurality of yarn segments. The fabric blank is formed by interweaving a plurality of first yarns and a plurality of composite yarns. Each composite yarn is composed of a second yarn and an elastic yarn. The second yarn is wound around the elastic yarn. The fabric blank has a first side, and a second side opposite to the first side and formed with a plurality of yarn loops. The yarn loops are formed by the interweaving of the first yarns and the composite yarns in a skip manner along a first direction or a second direction transverse to the first direction. The yarn segments are formed on the second side of the fabric blank by breaking at least some of the yarn loops.

According to another aspect of this disclosure, a method of making a woven brushed elastic fabric comprises the steps of: (A) preparing a fabric blank, the fabric blank being formed by interweaving a plurality of first yarns and a plurality of composite yarns, each of the composite yarns being composed of a second yarn and an elastic yarn, the second yarn being wound around the elastic yarn, the fabric blank having a first side, and a second side opposite to the first side and formed with a plurality of yarn loops, the yarn loops being formed by the interweaving of the first yarns and the composite yarns in a skip manner along a first direction or a second direction transverse to the first direction; and (B) breaking at least some of the yarn loops so that each of the broken yarn loops is formed with two yarn segments.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
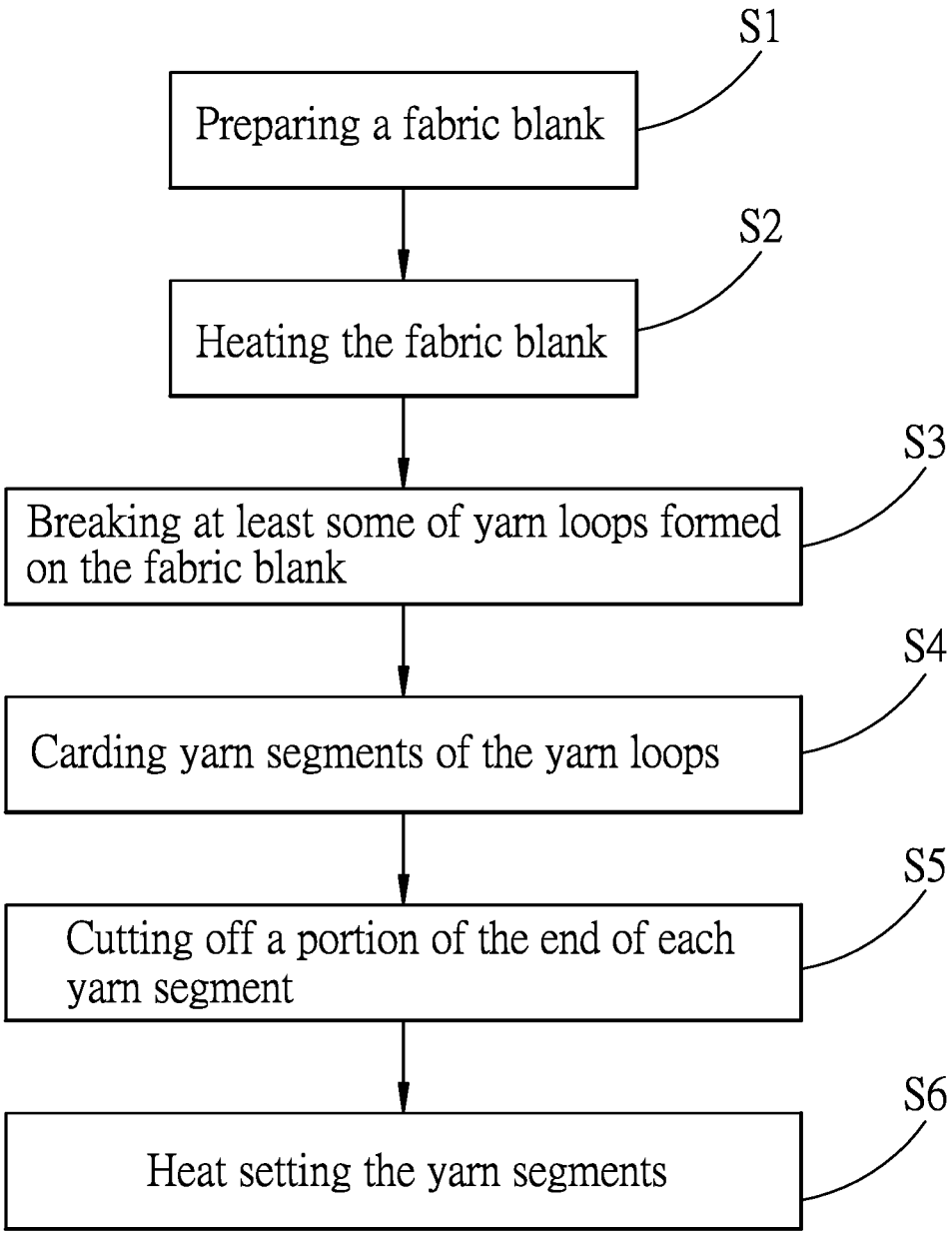
FIG. 1 is a flow diagram, illustrating the steps involved in a method of making a woven brushed elastic fabric according to the embodiment of the present disclosure.

Referring to FIG. 1, a method of making a woven brushed elastic fabric according to the embodiment of the present disclosure is shown to comprise steps (S1) to (S6). The steps of the embodiment will be described in detail below with reference to FIGS. 2, 3 and 4A-4E.

Figure 2:
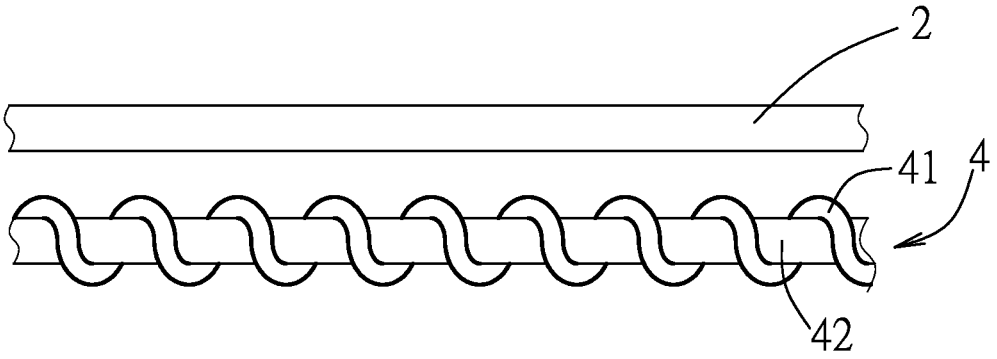
FIG. 2 illustrates a composite yarn of the embodiment being composed of an elastic yarn and a second yarn wound around the elastic yarn.
Figure 3:
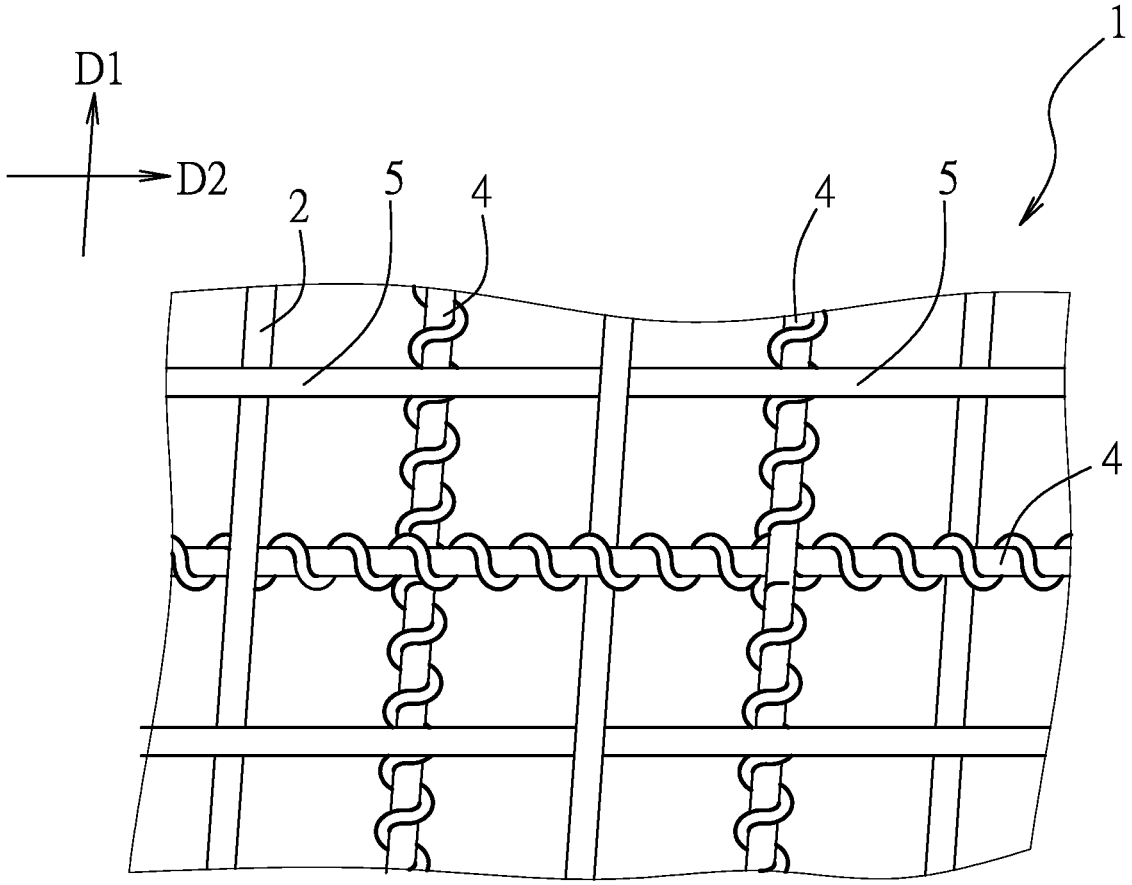
FIG. 3 is an enlarged fragmentary schematic view of a fabric blank of the embodiment.
Figure 4A:
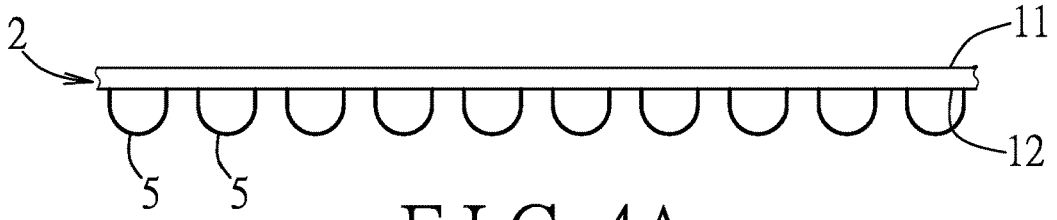
FIGS. 4A to 4E are fragmentary schematic views, illustrating the steps involved in the method of the embodiment.

In step (S1), a fabric blank 1 is made and prepared. A plurality of first yarns 2 and a plurality of composite yarns 4 are interwoven to form the fabric blank 1, as shown in FIG. 3. Each composite yarn 4 is composed of an elastic yarn 42 and a second yarn 41 wound around the elastic yarn 42, as shown in FIG. 2. The winding of the yarns may be accomplished using an air covering or single covering (not shown) method, so that the second yarn 41 covers the elastic yarn 42 to form the composite yarn 4 into an air covering yarn (ACY) or single covering yarn (SCY). The fabric blank 1 has a first side 11, and a second side 12 opposite to the first side 11 and formed with a plurality of yarn loops 5, as shown in FIG. 4A. The yarn loops 5, as shown in FIG. 3, are formed by the interweaving of the first yarns 2 and the composite yarns 4 in a skip manner along a first direction (D1) or a second direction (D2) transverse to the first direction (D1). The skip manner means that the first yarns 2 and composite yarns 4 are arranged in an alternating manner in the first direction (D1) or the second direction (D2). The number of the skipped yarns exemplified in this embodiment is two, but is not limited thereto.

In this embodiment, each of the first and second yarns 2, 41 is a draw textured yarn made from synthetic fiber (such as polyester, polyamide, polypropylene, polyethylene), preferably polyester. However, it may also be a high oriented yarn, a fully draw yarn, or a natural fiber (such as cotton, linen, wool, silk, viscose, rayon, lyocell, animal fiber, plant fiber, etc.), and is not limited to what is disclosed herein. The elastic yarn 42 is made of polyurethane fiber.

Figure 5:
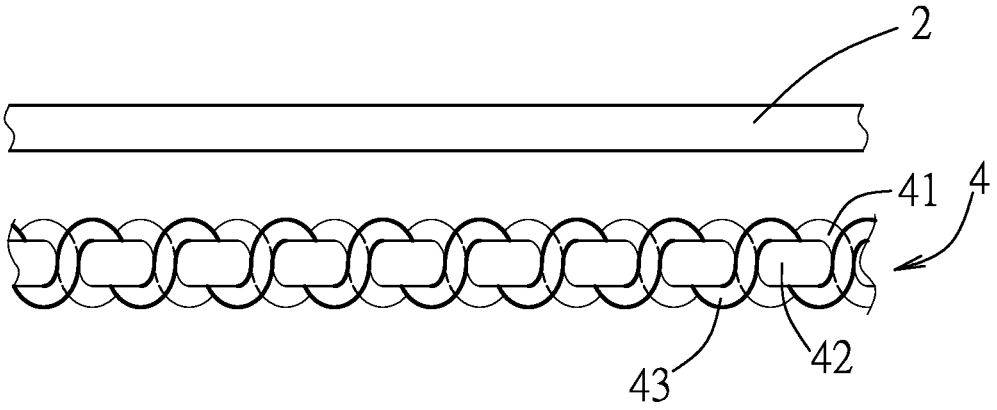
FIG. 5 illustrates an alternative form of the composite yarn of the embodiment.

In an alternative form of this embodiment, each composite yarn 4 may further be composed of a third yarn 43 wound around the elastic yarn 42 in a direction opposite to that in which the second yarn 41 is wound around the elastic yarn 42, as shown in FIG. 5, so that the second and third yarns 41, 43 cover the elastic yarn 42 to form the composite yarn 4 into a double covering yarn (DCY). Through the presence of the third yarn 4, the structure of the composite yarn 4 can be strengthened. The third yarn 4 may be made of a material similar to that of the first and second yarns 2, 41, or a material having functions, such as water repellent, deodorization, anti-bacterial, fire retardant, etc.

In step (S2), the fabric blank 1 is heated so as to shrink the fabric blank 1, to reduce the gaps among the yarn loops 5 and to enlarge the yarn loops 5. This step can increase the density of the yarn loops 5, and the number of the yarn loops 5 is between 15 and 1000 per square centimeter.

Figure 4B:
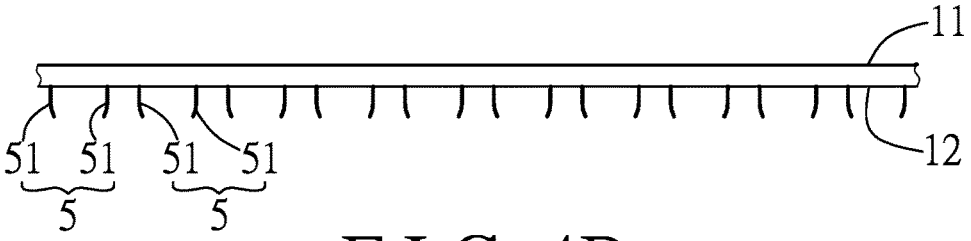

In step (S3), some of the yarn loops 5 are broken so that each broken yarn loop 5 is formed with two yarn segments 51, as shown in FIG. 4B. It should be noted herein that, although not all of the yarn loops 5 are broken in this embodiment, in other embodiments, all of the yarn loops 5 may be broken. However, this will result in higher production costs. In this embodiment, a brush finishing is used to capture and break the yarn loops 5 so that each broken yarn loop 5 is formed with the two yarn segments 51. This is done by feeding the fabric blank 1 to a conveyor belt of the brushing device, and a plurality of needle bars of the brushing device are hooked to the yarn loops 5 to break the same, so that each broken yarn loop 5 is formed with the two yarn segments 51. Each of the yarn segments 51 has a length (L1) at least 1.5 times larger than a thickness (T) of the fabric blank 1.

Figure 4C:
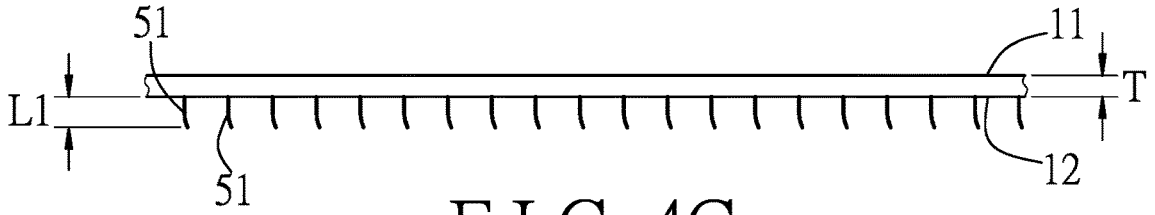

In step (S4), the yarn segments 51 are carded using a carding machine such that each yarn segment 51 is straightened along a direction away from the fabric blank 1, so that the appearance of the second side 12 of the fabric blank 1 is neat, as shown in FIG. 4C.

Figure 4D:
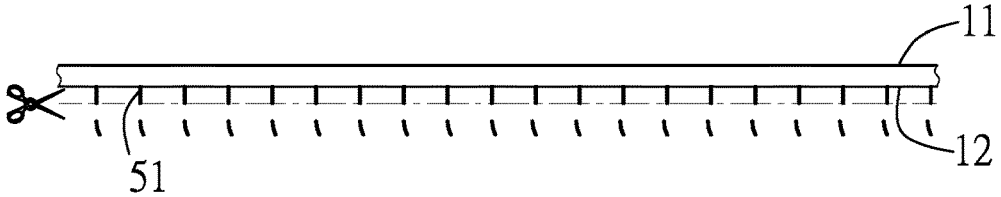

In step (S5), a portion of the end of each yarn segment cut off, so that the distance of the end of each yarn segment 51 (B) from the second side 12 of the fabric blank 1 is the same, as shown in FIG. 4D. In this step, a shearing machine (not shown) is used to cut off the portion of the end of each yarn segment 51 so that the length (L2) of each yarn segment 51 is larger than or equal to the thickness (T) of the fabric blank 1 and the second side 12 of the fabric blank 1 is smooth. The denier per filament (d/f) of each yarn segment 51 after this step is between 0.1 and 5.

Figure 4E:
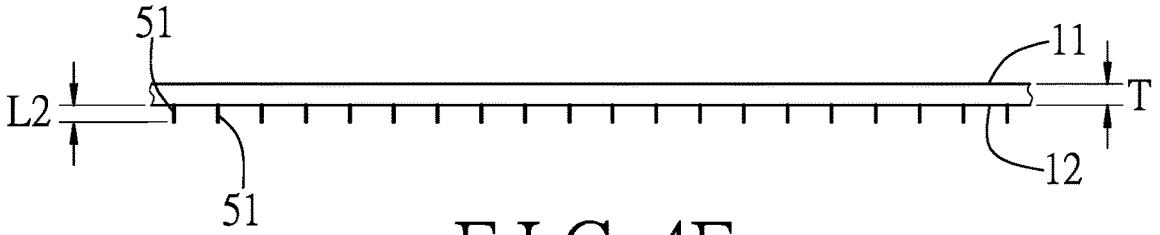

In step (S6), the yarn segments 51 are heated so that the yarn segments 51 are hardened and set to shape, as shown in FIG. 4E. In this embodiment, the yarn segments 51 are heated at a temperature lower than 180 degrees. The making of the woven brushed elastic fabric of this disclosure is thus completed, and the woven brushed elastic fabric of this disclosure has a feel similar to that of a fleece.

Figure 6:
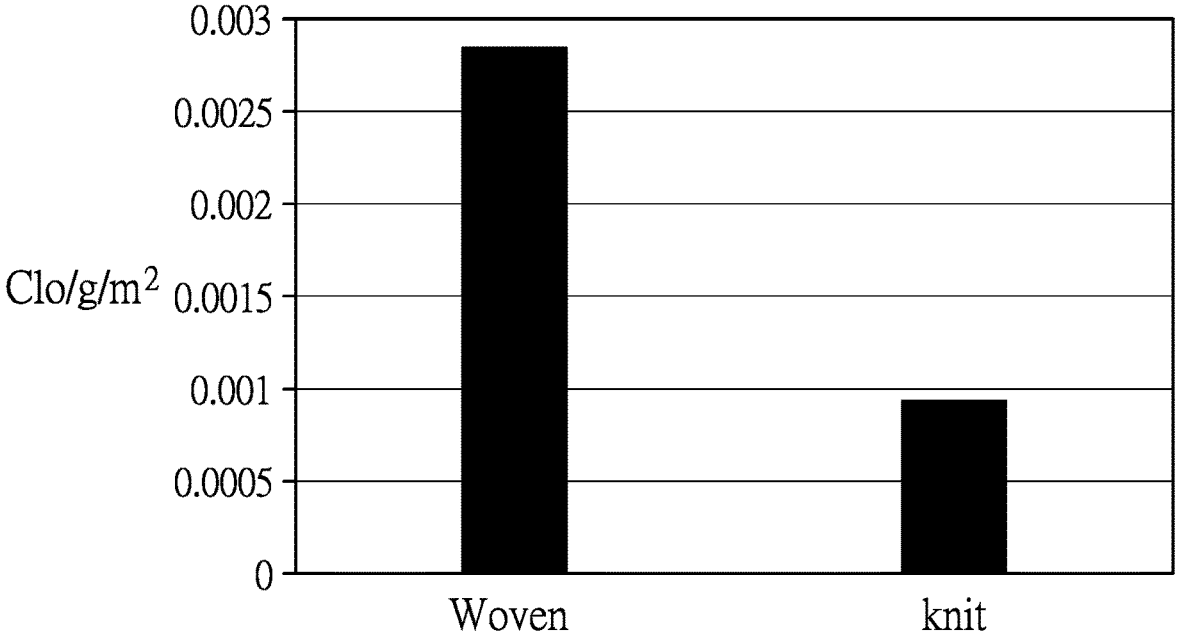
FIG. 6 is a graph, illustrating a comparison of the insulation value in Clo per g/m$^2$ between the woven brushed elastic fabric of this embodiment and a knitted brushed elastic fabric at a same weight of 210 g/m$^2$.

The woven brushed elastic fabric of this disclosure can be used to make clothings, such as a shirt, a blouse, pants, etc. When a user wears the clothing made from the fabric of this disclosure, his/her skin will contact the yarn segments 51 heated and set to shape in step (S6), so that a space for retaining air is formed between the user's skin and the yarn segments 51. Since air is a poor conductor of heat, the woven brushed elastic fabric of this disclosure can provide the function of warm-keeping. The clothing insulation value of the woven brushed elastic fabric of this disclosure obtained after intrinsic thermal resistance testing (ASTMD1518-11a) is greater than 0.6 of Clo value. FIG. 6 compares the insulation value in Clo per $g/m^2$ between the woven brushed elastic fabric of this disclosure and a knitted brushed elastic fabric at a same weight of 210 $g/m^2$. It is shown that the woven brushed elastic fabric of this disclosure has a value of 0.00286 $Clo/g/m^2$ which is higher than a value of 0.00095 $Clo/g/m^2$ of the knitted brushed elastic fabric. Hence, the woven brushed elastic fabric of this disclosure has a better insulation in clothing than the knitted brushed elastic fabric.

Figure 7:
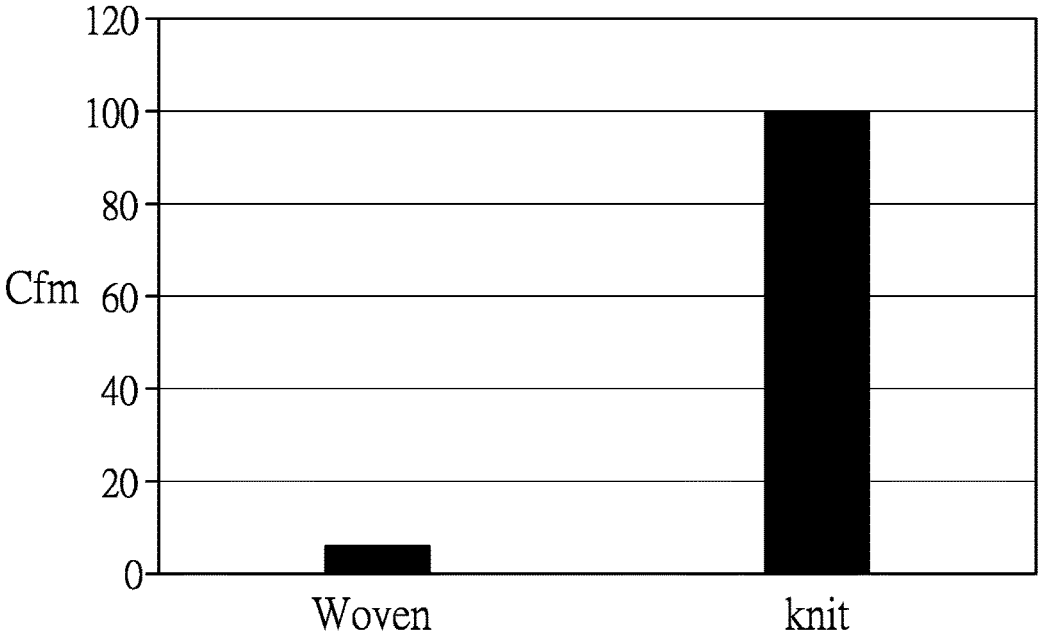
FIG. 7 is a graph, illustrating a comparison of the windproof value in cfm between the woven brushed elastic fabric of this disclosure and the knitted brushed elastic fabric at a same weight of 210 g/m$^2$.

The fabric blank 1 of the woven brushed elastic fabric of this disclosure is made by weaving. Thus, the clothing made from the woven brushed elastic fabric of this disclosure has characteristics, such as high density, abrasion resistance, waterproof and windproof. The windproof value is lower than 20 cfm (cubic feet per minute) by using ASTM D737 testing method. FIG. 7 compares the windproof value in cfm between the woven brushed elastic fabric of this disclosure and the knitted brushed elastic fabric at the same weight of 210 $g/m^2$. It is shown that the woven brushed elastic fabric of this disclosure has a value of 6.43 cfm which is quite lower than a value of 100 cfm of the knitted brushed elastic fabric. Hence, the woven brushed elastic fabric of this disclosure has a better windproof in clothing than the knitted brushed elastic fabric.

Figure 8:
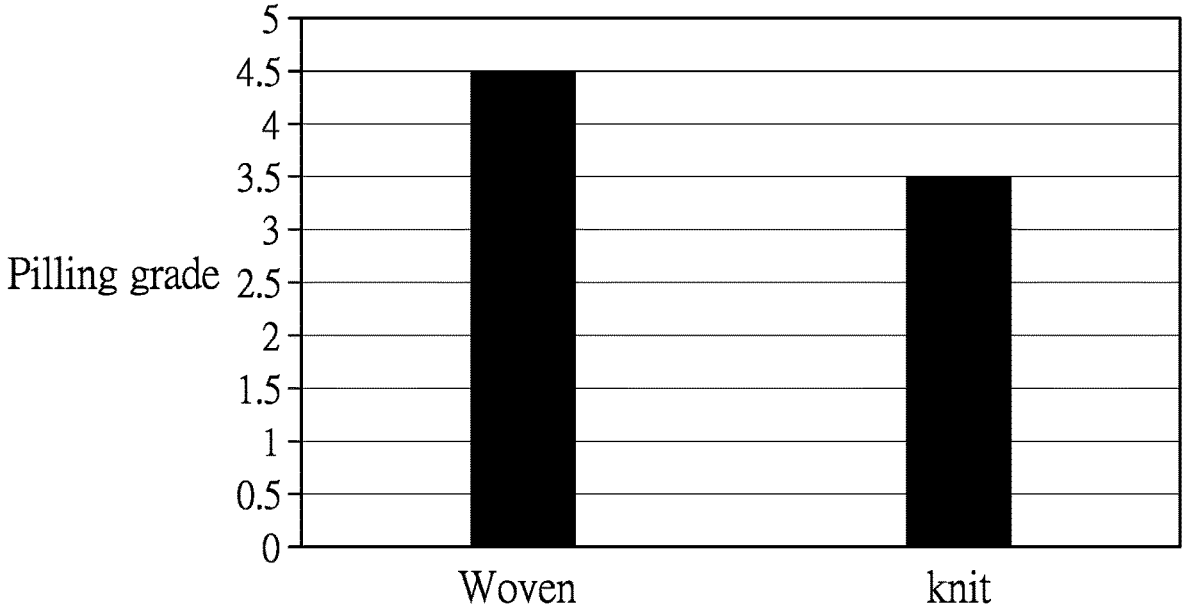
FIG. 8 is a graph, illustrating a comparison of the pilling grade between the woven brushed elastic fabric of this disclosure and the knitted brushed elastic fabric.

The woven brushed elastic fabric of this disclosure has an abrasion resistance rating falling between grade (minimum pilling) and grade 5 (no pilling) of the classification by using ASTM D4970 testing method. FIG. 8 compares the pilling test between the woven brushed elastic fabric of this disclosure and the knitted brushed elastic fabric. It is shown the woven brushed elastic fabric of this disclosure has grade 4.5 which is better than grade 3.5 of the knitted brushed elastic fabric. Hence, the woven brushed elastic fabric of this disclosure has a better abrasion resistance in clothing than the knitted brushed elastic fabric.

Figure 9:
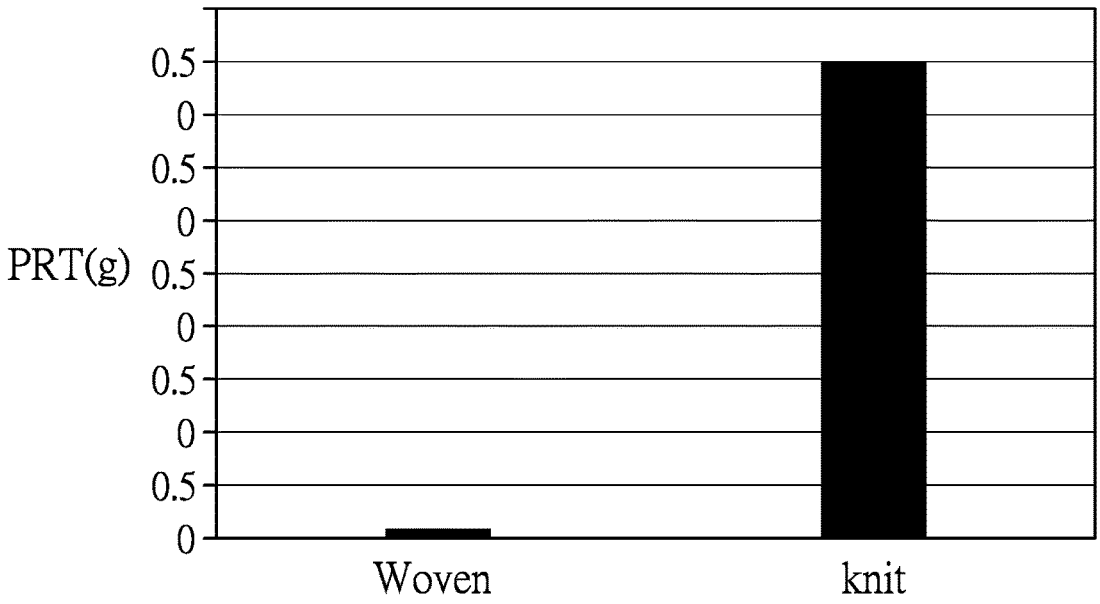
FIG. 9 is a graph, illustrating a comparison of pass rain test (PRT) between the woven brushed elastic fabric of this disclosure and the knitted brushed elastic fabric at a same weight of 210 g/m$^2$.

Further, when the woven brushed elastic fabric of this disclosure is first covered by a weighed water-absorbent paper, and then runs the rain test for two minutes under the water pressure of 600 mm according to AATCC 35 pass rain testing (PRT) method, the weight of the water-absorbent paper after testing is only increased by less than one (1) gram. FIG. 9 compares the PRT test between the woven brushed elastic fabric of this disclosure and the knitted brushed elastic fabric at the same weight of 210 $g/m^2$. It is shown that the woven brushed elastic fabric of this disclosure has a PRT value of 0.4 g which is better than a PRT value of 18 g of the knitted brushed elastic fabric. Hence, the woven brushed elastic fabric of this disclosure has a better rain resistance in clothing than the knitted brushed elastic fabric.

Moreover, when a water repellent agent is used on the woven brushed elastic fabric of this disclosure, the rating of the water repellence (AATCC 22) before washing is five (5), while the rating of the water repellence after washing (50 times) is four (4). It should be noted herein that step (S2), step (S4), step (S5) and step (S6) may be dispensed herewith. That is, the woven brushed elastic fabric may be made by just using step (S1) and step (S3) of this disclosure. However, the addition of step (S2), step (S4), step (S5) and step (S6) can greatly improve the quality of the woven brushed elastic fabric of this disclosure.

The construction of the conventional knitted brushed fabric belongs to a plain fabric, using a yarn plats on a ground yarn in the knitting process. During the process, ground yarn will form long loops, and after being destroyed through the brushing finish, loop lengths are formed. In contrast with the construction of woven fabric in the weaving process, weft yarns interweave through the warp yarns. Ground yarn under the weaving point must need the shrinkage of an elastic yarn to form long loops, after which a brushing finish should be executed.

In sum, the method of making the woven brushed elastic fabric of this disclosure uses the fabric blank 1 which is made by weaving and which has characteristics, such as good abrasion resistance, windproof and waterproof. Moreover, the gaps among the yarn segments 51 can accommodate air to provide the warm-keeping function. Hence, the object of this disclosure can indeed be achieved.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A method of making a woven brushed elastic fabric, comprising:

(A) preparing a fabric blank, the fabric blank being formed by interweaving a plurality of first yarns and a plurality of composite yarns, each of the composite yarns being composed of a second yarn and an elastic yarn, the second yarn being wound around the elastic yarn, the fabric blank having a first side, and a second side opposite to the first side and formed with a plurality of yarn loops, the yarn loops being formed by the interweaving of the first yarns and the composite yarns in a skip manner along a first direction or a second direction transverse to the first direction, each of the yarn loops having a gap between another yarn loop;

(A1) heating the fabric blank so as to shrink the fabric blank, so as to reduce the gaps among the yarn loops and to enlarge the yarn loops; and (B) breaking only some of the yarn loops after the (A1) heating, wherein the fabric blank is fed to a conveyor belt of a brushing device having a plurality of needle bars that are hooked onto the yarn loops to break the yarn loops so that some of the broken yarn loops are each formed into two yarn segments.

2. The method as claimed in claim 1, further comprising a step (C) carding, after step (B), in which the yarn segments are carded such that each of the yarn segments is straightened along a direction away from the fabric blank, wherein in the carding, a carding machine is used to align the yarn segments of the broken yarn loop.

3. The method as claimed in claim 2, wherein each of the yarn segments has a length at least 1.5 times larger than a thickness of the fabric blank.

4. The method as claimed in claim 2, further comprising a step (D) after step (C), in which a portion of an end of each of the yarn segments is cut off.

5. The method as claimed in claim 4, wherein, after the portion of the end of each of the yarn segments is cut off, each of the yarn segments has a length larger than or equal to a thickness of the fabric blank.

6. The method as claimed in claim 4, further comprising a step (E) after step (D), in which the yarn segments are heated so that the yarn segments are hardened and set to shape.

7. The method as claimed in claim 1, wherein each of the first and the second yarns in step (A) is a yarn selected from the group consisting of a draw textured yarn made of synthetic fiber, a high oriented yarn, a fully draw yarn, and a natural fiber.

8. The method as claimed in claim 7, wherein each of the first and the second yarns is made of a synthetic fiber selected from the group consisting of polyester, polyamide, polypropylene, and polyethylene.

9. The method as claimed in claim 8, wherein the synthetic fiber is polyester.

10. The method as claimed in claim 7, wherein each of the first and second yarns is made of natural fiber selected from the group consisting of cotton, linen, wool, silk, viscose, rayon, lyocell, animal fiber, and plant fiber.

11. The method as claimed in claim 1, wherein each of the first and the second yarns in step (A) is a high oriented yarn made of polyester fiber.

12. The method as claimed in claim 1, wherein a number of the yarn loops in step (A1) is between 15 and 1000 per square centimeter.

13. The method as claimed in claim 4, wherein a denier per filament (d/f) of each of the yarn segments in step (D) is between 0.1 and 5.

14. The method as claimed in claim 4, wherein in step (D), a shearing machine is used to cut off the portion of the end of each of the yarn segments.

15. The method as claimed in claim 1, wherein each of the composite yarns is further composed of a third yarn wound around the elastic yarn in a direction opposite to that in which the second yarn is wound around the elastic yarn.

* * * * *